US008997776B2

(12) United States Patent
Yamauchi

(10) Patent No.: US 8,997,776 B2
(45) Date of Patent: Apr. 7, 2015

(54) COLOR CHANGE VALVE DEVICE

(75) Inventor: Kuniharu Yamauchi, Nagakute (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 13/982,601

(22) PCT Filed: Feb. 27, 2012

(86) PCT No.: PCT/JP2012/054743
§ 371 (c)(1),
(2), (4) Date: Jul. 30, 2013

(87) PCT Pub. No.: WO2012/169235
PCT Pub. Date: Dec. 13, 2012

(65) Prior Publication Data

US 2013/0320109 A1 Dec. 5, 2013

(30) Foreign Application Priority Data

Jun. 9, 2011 (JP) ..... 2011-129176

(51) Int. Cl.

| | |
|---|---|
| ***B05B 12/14*** | (2006.01) |
| ***B05B 15/02*** | (2006.01) |
| ***B01F 5/04*** | (2006.01) |
| ***B01F 5/06*** | (2006.01) |
| ***B01F 15/00*** | (2006.01) |
| *B05B 5/04* | (2006.01) |

(52) U.S. Cl.

CPC ..... *B05B 15/025* (2013.01); *B01F 5/0451* (2013.01); *B01F 5/0458* (2013.01); *B01F 5/0615* (2013.01); *B01F 15/00025* (2013.01); *B01F 2215/005* (2013.01); *B05B 12/149* (2013.01); *B05B 5/0407* (2013.01)

(58) Field of Classification Search

USPC ..... 137/238, 240, 266; 239/112
See application file for complete search history.

(56) References Cited

U.S. PATENT DOCUMENTS

| | | | | |
|---|---|---|---|---|
| 6,364,218 | B1 * | 4/2002 | Tudor et al. | 239/290 |
| 6,935,366 | B2 * | 8/2005 | Ciarelli et al. | 137/565.01 |

FOREIGN PATENT DOCUMENTS

| | | |
|---|---|---|
| JP | 6 134359 | 5/1994 |
| JP | 6 254450 | 9/1994 |
| JP | 7 204541 | 8/1995 |

(Continued)

OTHER PUBLICATIONS

Office Action issued Jun. 3, 2014 in Japanese Patent Application No. 2013-519402.

(Continued)

*Primary Examiner* — Kevin Lee
(74) *Attorney, Agent, or Firm* — Oblon, McClelland, Maier & Neustadt, L.L.P.

(57) ABSTRACT

A color change valve device includes: a manifold including on an inside a paint passage, and to which connector passages are provided to radially penetrate therethrough at plural locations axially spaced from each other; a wash air valve and a wash liquid valve connected to the connector passages at a most upstream side among the respective connector passages in the manifold; paint valves connected to the connector passages in the manifold to be positioned at a downstream side of the respective valves; and a swirl flow forming member provided in the paint passage in the manifold for forming a swirl flow by the wash air and the wash liquid, wherein the swirl flow forming member is arranged across an entire length of the paint passage.

6 Claims, 6 Drawing Sheets

(56) References Cited

FOREIGN PATENT DOCUMENTS

| | | |
|---|---|---|
| JP | 9-7509 | 1/1997 |
| JP | 2001 239190 | 9/2001 |
| WO | 2009 019984 | 2/2009 |

OTHER PUBLICATIONS

International Search Report Issued Apr. 2012 in PCT/JP12/054743 Filed Feb. 27, 2012.

* cited by examiner

COLOR CHANGE VALVE DEVICE

TECHNICAL FIELD

The present invention relates to a color change valve device suitable for use in a painting apparatus for spraying paints toward a work piece of, for example, an automobile, a household electrical product, and the like.

BACKGROUND ART

In general, a painting apparatus for spraying liquid paints on a work piece is largely constituted by a color change valve device for selecting and supplying paints of plural colors or wash fluids as needed, and a coater unit for spraying the paint supplied through a pipe from the color change valve device.

The color change valve device is structured of a manifold an inside of which forms a paint passage, and to which connector passages are provided to radially penetrate therethrough at plural locations axially spaced from each other, a wash fluid valve provided to be connected to the most upstream side connector passage among the respective connector passages in the manifold for performing supply and blockade of the wash fluid to the paint passage, and plural paint valves provided to be connected to the connector passages in the manifold to be positioned at the downstream side of the wash fluid valve for performing supply and blockade of the paint to the paint passage (Patent Document 1).

The color change valve device selects a desired paint from plural kinds of paints and supplies the selected paint to the coater unit. Accordingly, the color change valve device, at the time of changing a paint to be used for a spray work, washes out the previous color paint used in the previous spray work and stagnating in the paint passage of the manifold or the like, and, after washing out the previous color paint, supplies the next color paint to be used in the next spray work toward the coater unit.

In a case of performing the wash work of the previous color paint stagnant in the paint passage of the manifold or the like, when the spray work using the previous color paint is completed, the paint valve having supplied the previous color paint is closed. Thereafter, the wash fluid valve is opened to supply the wash fluid of wash air, a wash liquid or the like to the paint passage. Therefore, the wash fluid flows from the upstream side to the downstream side in the paint passage to push out the previous color paint stagnant in the paint passage and wash the previous color paint adhering to the inner wall surface of the paint passage.

Here, the previous color paint stagnant in the paint passage flows straight along the paint passage. Then the paint as viscosity fluid generates a pipe pressure loss on the inner wall surface side of the paint passage. Therefore, a velocity of the paint at the time the paint flows through the inner wall surface side (radial outside) in the paint passage is slower than that at the time the paint flows through an axis central part in the paint passage. Due to this phenomenon, the flowing velocity of the wash fluid is made slower at the inner wall surface side in the paint passage, and therefore the previous color paint can not be effectively pushed or flowed out by the wash fluid, creating the cause of degrading the wash performance.

Therefore, there is known a color change valve device which aims at improving the wash performance on the previous color paint stagnant in the paint passage. The color change valve device according to the conventional art provides an air-liquid mixer, which is composed of plural elements formed by twisting a plate body, in the paint passage. By flowing the wash fluid in the paint passage, the air-liquid mixer forms a wash liquid having fine, uniform air bubbles, and the wash liquid washes the previous color paint in the paint passage (Patent Document 2).

On the other hand, there is known the structure of improving the wash performance on the previous color paint stagnant in the paint supply line for supplying the paint from the color change valve device to the coater unit. This conventional art has the structure in which an element formed by twisting a plate body is housed in a joint component positioned at the upstream side of the paint supply line, and the wash fluid is forced to spirally flow in the paint supply line by the element, thus washing the previous color paint having adhered to the inner wall surface of the paint supply line (Patent Document 3).

PRIOR ART DOCUMENTS

Patent Documents

Patent Document 1: Japanese Patent Laid-Open No. H6-254450 A

Patent Document 2: Japanese Patent Laid-Open No. H6-134359 A

Patent Document 3: Japanese Patent Laid-Open No. H7-204541 A

SUMMARY OF THE INVENTION

Incidentally, the manifold in the color change valve device is provided with the paint passage formed therein, and, for connecting the paint passage to the respective paint valves and the wash fluid valve, the connector passages radially penetrating through the paint passage are respectively provided to be axially spaced from each other. Therefore, when each of the respective paint valves is closed after the spray work is completed, since each of the respective connector passages is closed at a side of the paint valve, each of the connector passages is in a state of being opened to the inner wall surface of the paint passage as a bottomed hole.

As a result, the paint flowing in the paint passage enters into and stagnates in the connector passage opened to the inner wall surface of the paint passage as the bottomed hole. As in the case of Patent Document 2, even if the wash liquid having micro air bubbles is made to flow in the paint passage in the color change valve device from the air-liquid mixer provided at the upstream side of the color change valve device, in the paint passage in which the paint as the viscosity fluid stagnates, the effective function for pushing out the paint on the inner wall surface side is not brought because of a pipe pressure loss operation generated on the inner wall surface side.

In addition, as in the case of Patent Document 3, even if the element for generating the spiral flow in the wash fluid is provided at the upstream side of the paint passage in the color change valve device, since the spiral wash fluid loses the spiral function due to the paint as the viscosity fluid at an earlier stage where the spiral wash fluid enters into the paint passage, the effective function for pushing out the paint on the inner wall surface side in the paint passage is not brought as similar to the wash liquid in Patent Document 2. Furthermore, the wash fluid is extremely low in the pushing-out function of the paint to the paint stagnant in the connector passages provided outside of the inner wall surface in the paint passage, thus requiring long hours for washing the paint.

In view of the above-discussed problems with the conventional art, it is an object of the present invention to provide a color change valve device in which a wash fluid maintains a spiral function across an entire surface from upstream to downstream of the inner wall surface in a paint passage formed in a manifold to actively push and flow out paints stagnant on the inner wall surface of the paint passage and in connector passages, thus making it possible to efficiently wash the paint.

(1) A color change valve device according to the present invention comprises a manifold an inside of which forms a paint passage, and to which connector passages are provided to radially penetrate therethrough at plural locations axially spaced from each other, a wash fluid valve provided to be connected to the connector passage at the most upstream side among the respective connector passages in the manifold for performing supply and blockade of a wash fluid to the paint passage; and plural paint valves provided to be connected to the connector passages in the manifold to be positioned at the downstream side of the wash fluid valve for performing supply and blockade of paints to the paint passage.

In order to solve the above-mentioned problem, a characteristic adopted by the present invention is that a swirl flow forming member is provided in the paint passage in the manifold for forming a swirl flow by the wash fluid in the paint passage, wherein the swirl flow forming member is arranged across an entire length of the paint passage.

With this arrangement, the swirl flow forming member provided across the substantially entire length of the paint passage in the manifold can flow the wash fluid supplied from the wash fluid valve into the paint passage as the swirl flow. Therefore, the wash fluid having simply flown straight from the upstream side to the downstream side in the paint passage can be made to flow toward the radial outside of the paint passage, that is, toward the entire surface of the inner wall surface in the paint passage. Accordingly, the wash fluid can be actively flown and supplied on the inner wall surface of the paint passage and to the connector passage opened to the inner wall surface. It should be noted that the swirl flow forming member is only required to be arranged substantially across the entire length of the paint passage, which does not mean that a passage length of the paint passage is equal in dimension to a length of the swirl flow forming member.

As a result, at the time of washing the paint passage, the paint stagnant on the inner wall surface of the paint passage can be effectively pushed and flown out in a short time by the swirl flow generated by the swirl flow forming member. Further, since the swirl flow forming member can force the wash fluid to actively flow also into the respective connector passages, the paint stagnant in the inner part of the connector passage can be also washed in a short time.

(2) According to the present invention, the swirl flow forming member is formed as a single member arranged in a state of being freely movable in the paint passage. Here, the state of being freely movable means a state where the swirl flow forming member can vibrate or rotate in the front and rear directions, in the right and left directions, and in the upward and downward directions in the paint passage. As a result, the swirl flow forming member can divide or stir the paint stagnant on the inner wall surface of the paint passage by complex behaviors such as vibration or rotation, and can cause the wash fluid to actively collide with the inner wall surface of the paint passage. Therefore, the paint having adhered to the inner wall surface can be efficiently washed out.

(3) According to the present invention, the swirl flow forming member is formed with a plurality of successive unit spirals, each unit spiral comprising a front surface and a back surface reversed by 180-degree twist thereof, and is provided in a state of being movable in the paint passage.

With this arrangement, the wash fluid can be flown to be divided into a passage at the front surface side and a passage at the rear surface side of the spiral which forms the swirl flow forming member. Therefore, the wash fluid can be made to flow toward the radial outside in the paint passage, that is, toward the inner wall surface of the paint passage.

In addition, since the swirl flow forming member is provided in a state of being movable in the paint passage, it can be pushed and moved by the wash fluid supplied, to vibrate in an axial direction and a radial direction or rotate in a circumferential direction. Such vibration or rotation of the swirl flow forming member enables the paint stagnant on the inner wall surface of the paint passage to be divided or stirred, making it possible to improve the wash efficiency of the paint also in this respect.

(4) According to the present invention, the swirl flow forming member is structured by a single plate body comprising the plurality of the unit spirals successively formed.

With this arrangement, since the swirl flow forming member formed of the single plate body can eliminate the step between the respective unit spirals, the wash fluid can be made to smoothly flow along the swirl flow forming member, increasing a flow velocity of the wash fluid to improve the wash performance. Further, the swirl flow forming member of the single plate body can be easily inserted into or removed from the paint passage.

(5) According to the present invention, the swirl flow forming member is formed using a resin material having flexibility or a metallic material having flexibility.

With this arrangement, since the swirl flow forming member has the flexibility, it can be deflected subjected to a pressure of the wash fluid supplied, to be actively vibrated. Thereby, since an outer peripheral section of the swirl flow forming member can repeatedly make contact with the inner wall surface of the paint passage, the paint stagnant on the inner wall surface of the paint passage can bestirred to increase the wash efficiency.

(6) According to the present invention, the swirl flow forming member is structured having a radial outside diameter dimension formed smaller by a slight radial gap than an inside diameter dimension of the paint passage in such a manner as to be radially movable to the paint passage. Therefore, the swirl flow forming member can be made to radially vibrate or to circumferentially rotate in the paint passage.

(7) According to the present invention, the swirl flow forming member is structured having an axial length dimension formed shorter by a slight axial gap than a length dimension of the paint passage in such a manner as to be axially movable to said paint passage. Therefore, the swirl flow forming member can be made to axially vibrate in the paint passage.

(8) According to the present invention, a positioning member is provided in a downstream end portion of the manifold to allow outflow of the fluid from the paint passage and position a fore end of the swirl flow forming member inserted into the paint passage, an opening portion is provided in an upstream end portion of the manifold to insert and remove the swirl flow forming member, and a lid member is provided in a position for closing the opening portion to position a base end of the swirl flow forming member.

With this arrangement, the positioning member provided in the downstream end portion of the manifold allows outflow of the paint supplied from the paint valve and the wash fluid supplied from the wash fluid valve toward the coater unit or the like. Besides, the positioning member can determine a movement end of the swirl flow forming member to the downstream side in such a manner that the swirl flow forming member does not withdraw to the downstream side.

On the other hand, since the opening portion is provided in the upstream end portion of the manifold, the swirl flow forming member can easily be inserted into or removed from the paint passage through the opening portion. Further, in a state of mounting the lid member to the opening portion, the opening portion can be closed by the lid member, and the lid member can determine the movement end of the swirl flow forming member to the upstream side in such a manner that the swirl flow forming member is not withdrawn to the upstream side.

MODE FOR CARRYING OUT THE INVENTION

Hereinafter, color change valve devices according to embodiments of the present invention will be in detail explained with reference to the accompanying drawings, by taking the structure of supplying paints to a coater unit as an example.

FIG. 1 to FIG. 7 show a first embodiment in the present invention. The first embodiment exemplifies a case of supplying six colors of paints of color A to F selected from many paints of color A to N to the electrostatic type coater unit. In addition, the first embodiment exemplifies a case of using a rotary atomizing head type coater unit 8 as a representative example of the coater unit 8.

Figure 1:
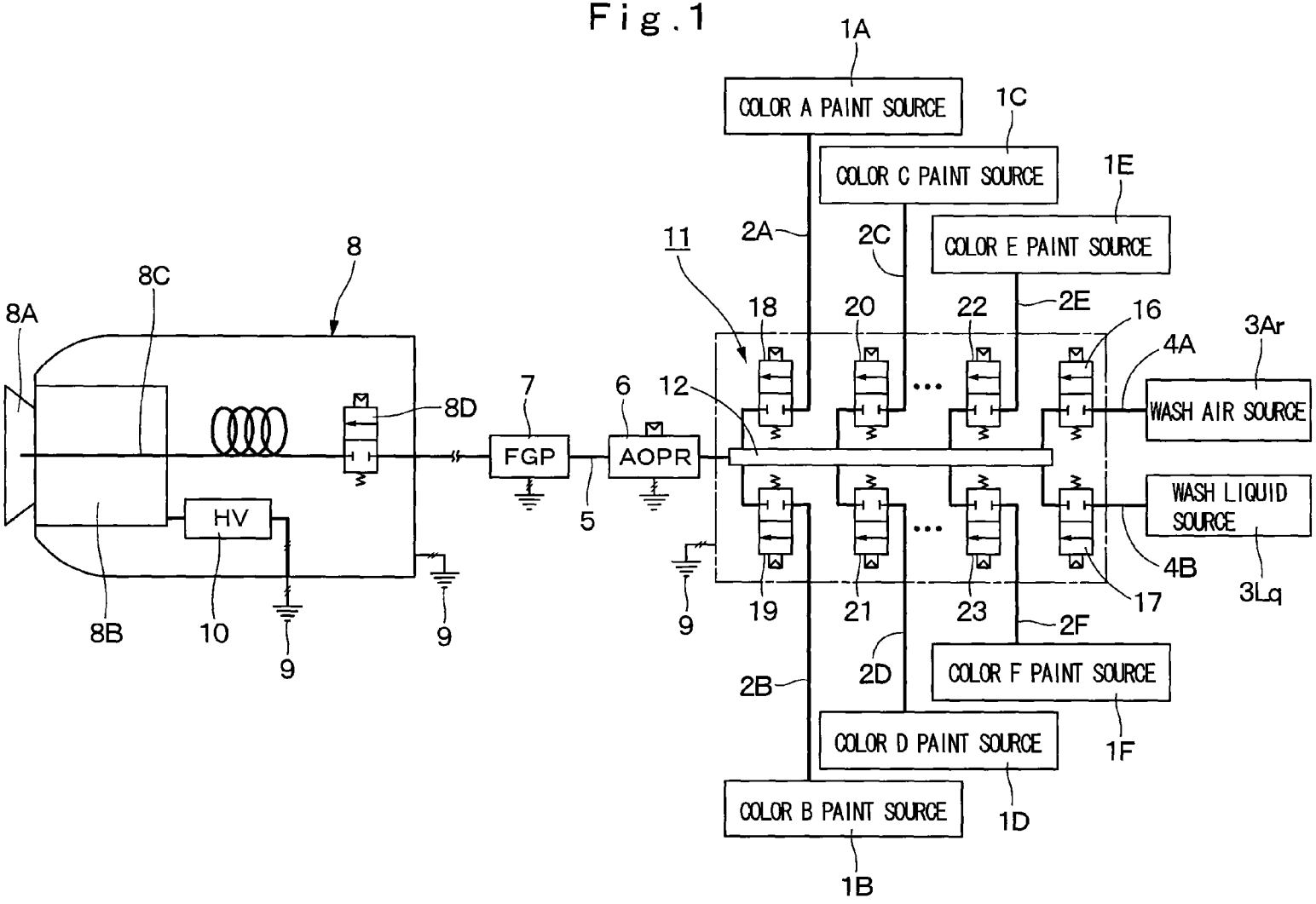
FIG. 1 is an entire structure diagram showing a coater unit using a color change valve device according to a first embodiment of the present invention.

In FIG. 1, indicated at 1A, 1B, 1C, 1D, 1E, and 1F are paint sources of color A, color B, color C, color D, color E, and color F respectively. The paint sources 1A to 1F of color A to F are connected through paint lines 2A to 2F to respective paint valves 18 to 23 in a color change valve device 11 to be described later.

Indicated at 3Ar is a wash air source for supplying wash air as a wash fluid, and the wash air source 3Ar is connected through an air line 4A to a wash air valve 16 in the color change valve device 11 to be described later. Indicated at 3Lq is a wash liquid source for supplying a wash liquid as a wash fluid, and the wash liquid source 3Lq is connected through a liquid line 4B to a wash liquid valve 17 in the color change valve device 11.

Indicated at 5 is a paint supply line connected to an outlet side of the color change valve device 11 to be described later, and the paint supply line 5 guides the paint or the like supplied from the color change valve device 11 to the coater unit 8 to be described later. The paint supply line 5 has an upstream end connected to a joint member 14 in a manifold 12 to be described later and a downstream end connected to a trigger valve 8D in the coater unit 8.

A paint regulator 6 is provided to be positioned at the downstream side of the color change valve device 11. The paint regulator 6 adjusts a valve opening degree corresponding to a control air pressure to control a pressure and a discharge quantity of the paint to be supplied to the coater unit 8 from the color change valve device 11. It should be noted that the paint regulator 6 adopts an air operated paint regulator (air operated paint regulator: AOPR) as an example.

A paint pump 7 is provided in the halfway of the paint supply line 5 to be in the positioned downstream side of the paint regulator 6 and this paint pump 7 is formed of a volumetric pump such as a gear pump or a rotary pump, and quantitatively supplies the paint selected in the color change valve device 11 to the coater unit 8. It should be noted that the paint pump 7 adopts a flushable gear pump (FGP) as an example.

Indicated at 8 is the rotary atomizing head type coater unit provided at the downstream side of the paint supply line 5 and this coater unit 8 is mounted on, for example, an arm fore end of a paint robot (not shown) (hereinafter, the rotary atomizing head type coater unit 8 is called as a coater unit 8 simply). Here, the coater unit 8 is retained through an earth 9 to an earth potential as a whole. It should be noted that the first embodiment exemplifies the rotary atomizing head type coater unit 8 as the coater unit 8, but may adopt a spray gun type coater unit or a hydraulic atomizing type coater unit.

The coater unit 8 is provided with a rotary atomizing head 8A for spraying a paint toward a work piece, an air motor 8B for driving and rotating the rotary atomizing head 8A at high speeds, and a feed tube 8C for supplying a paint or the like toward the rotary atomizing head 8A.

The coater unit 8 is provided with a trigger valve 8D connected to the feed tube 8C, and the trigger valve 8D supplies or stops the paint or the wash fluid supplied from the paint supply line 5, toward the rotary atomizing head 8A from the feed tube 8C. The trigger valve 8D is structured as an air operated on-off valve of a normally closed type having two ports and two positions for opening/closing the feed tube 8C by a valve body which is opened and closed by supplying control air to a control room and displacing a piston (none are shown).

A high voltage generator 10 is provided between the coater unit 8 and the earth 9 and this high voltage generator 10 is formed of, for example, a cock croft circuit, and increases a voltage supplied from a power source device (not shown) to −60 kV to −150 kV. An output side of the high voltage generator 10 is connected electrically, for example, to an air motor 8B, and the high voltage generator 10 applies a high voltage to the rotary atomizing head 8A, for directly charging high voltage to the paint to be supplied to the rotary atomizing head 8A.

Next, the structure, the color change operation, and the like in regard to the color change valve device 11 according to the first embodiment in the present invention, will be explained in greater detail.

In the first embodiment, a case of supplying six colors of paints among color A to N of paints to a paint passage 13 in the manifold 12 will be explained as an example. That is, an explanation will be made of a specific example of the color change valve device 11 in which eight valve bodies of the wash air valve 16, the wash liquid valve 17, the color A paint valve 18, the color B paint valve 19, the color C paint valve 20, the color D paint valve 21, the color E paint valve 22, and the color F paint valve 23 are mounted to the manifold 12, and the paint selected from the six colors of the paints is supplied to the coater unit 8.

Designated at 11 is the color change valve device according to the first embodiment, which is provided to be connected to the upstream side of the paint supply line 5. The color change valve device 11 selects a paint to be supplied to the coater unit 8 from the six colors of color A, color B, color C, color D, color E, and color F at a spray operation, and supplies the selected paint through the paint supply line 5 to the feed tube 8C. On the other hand, the color change valve device 11, at a wash work of the paint stagnant in the rotary atomizing head 8A, the feed tube 8C, and the trigger valve 8D in the coater unit 8, in the paint supply line 5, and in the paint passage 13 in the manifold 12 to be described later, supplies the wash air and the wash liquid as the wash fluid to them.

Figure 2:
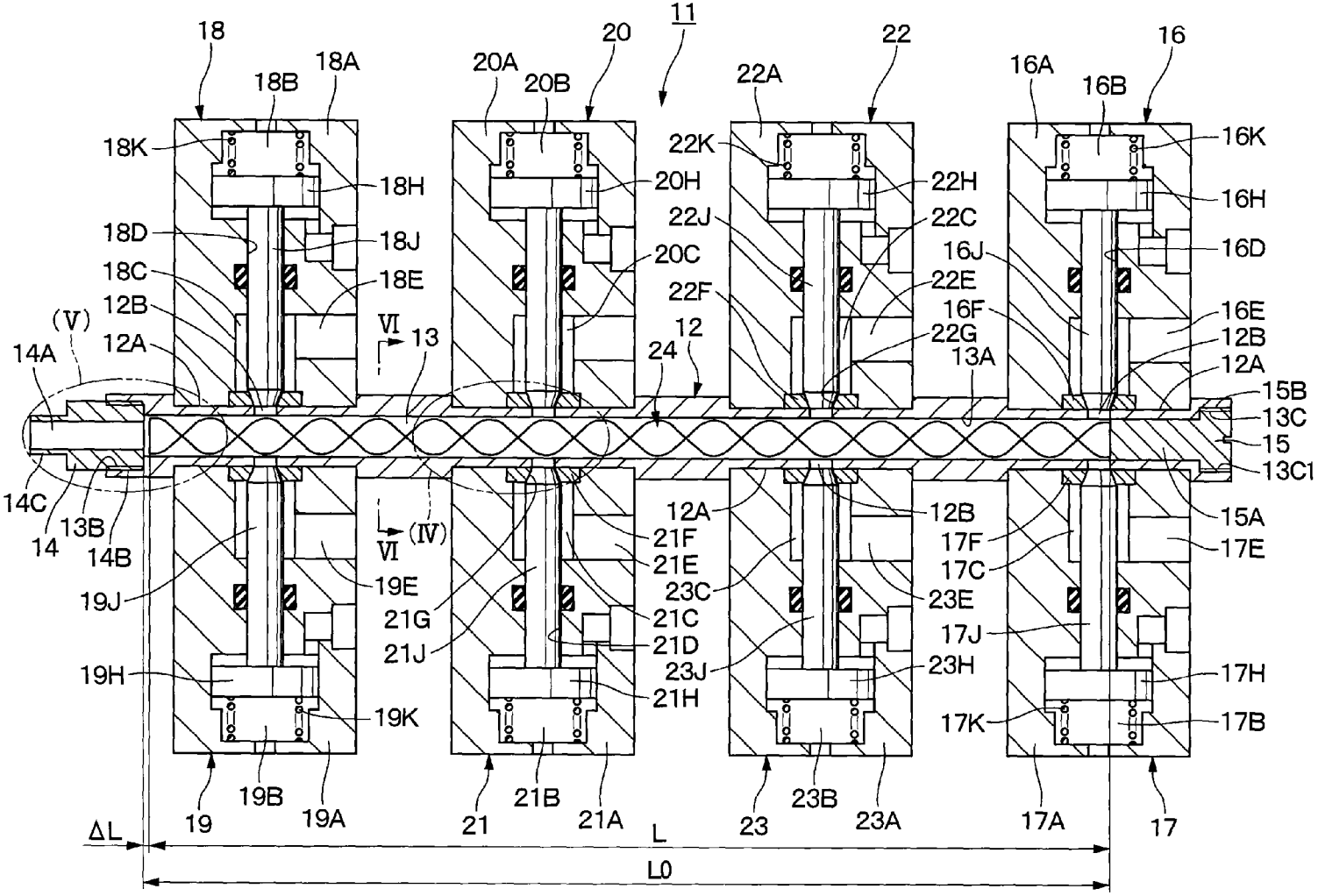
FIG. 2 is a longitudinal cross-sectional view showing the color change valve device in FIG. 1.

The color change valve device 11 is a device for selectively supplying and controlling the paint and the wash fluid toward the coater unit 8 and as shown in FIG. 2, the color change valve device 11 is structured of the manifold 12, the paint passage 13, the joint member 14, the lid member 15, the wash air valve 16, the wash liquid valve 17, the paint valves 18 to 23, the swirl flow forming member 24, and the like, which will be described later.

Indicated at 12 is the manifold forming a principle part of the color change valve device 11 and this manifold 12 serves as a base of mounting the wash air valve 16, the wash liquid valve 17, and the respective paint valves 18 to 23, which will be described later, and also is formed as a hollow body provided with the paint passage 13 in common to the respective valves 16, 17, and 18 to 23. The manifold 12 has, for example, a rectangular column-shaped contour elongated in an axial direction of the paint passage 13, and includes eight valve mount recesses 12A axially formed by intervals on surface portions opposing in a direction perpendicular to the axial direction for mounting the respective valves 16, 17, and 18 to 23. A connector passage 12B is provided in a central position of each of the valve mount recesses 12A to be penetrated in a radial direction of the paint passage 13. Therefore, when the respective valves 16, 17, and 18 to 23 opens, outlet ports 16G to 23G of valve seats 16F to 23F of the respective valves can be communicated through the connector passages 12B with the paint passage 13.

Indicated at 13 is the paint passage provided to extend in a longitudinal direction inside the manifold 12 and this paint passage 13 serves as a passage in which in a case of performing a spray work, the paints of color A to F supplied from the respective paint valves 18 to 23 flow. On the other hand, in a case of washing the paint stagnant in the paint passage 13, the paint passage 13 serves as a passage in which the wash air and the wash liquid supplied from the wash air valve 16 and the wash liquid valve 17 flow. The paint passage 13 is formed as a circular passage having an inside diameter dimension D0 and axially penetrating inside the manifold 12. Each of the connector passages 12B is opened in a communicating state to an inner wall surface 13A of the paint passage 13.

Figure 3:
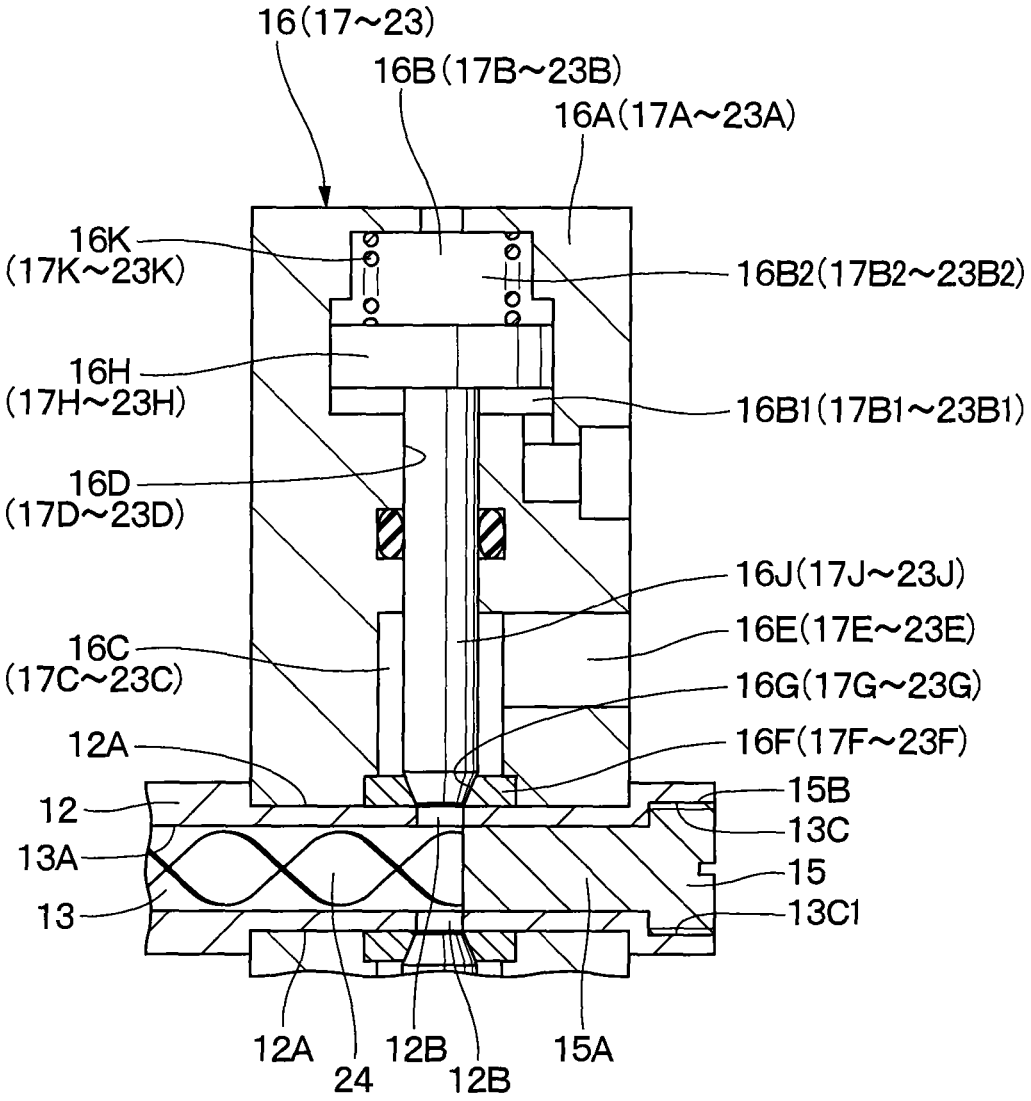
FIG. 3 is a longitudinal cross-sectional view shown by enlarging a wash air valve in FIG. 2.
Figure 4:
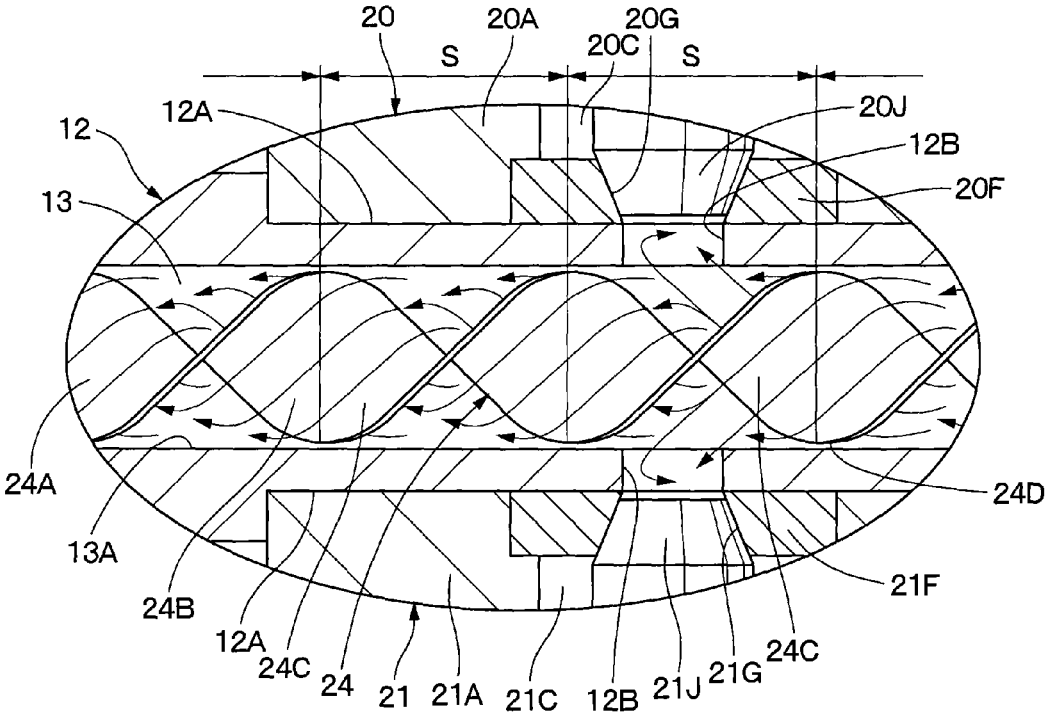
FIG. 4 is a longitudinal cross-sectional view of essential portions shown by enlarging a IV part in FIG. 2.
Figure 5:
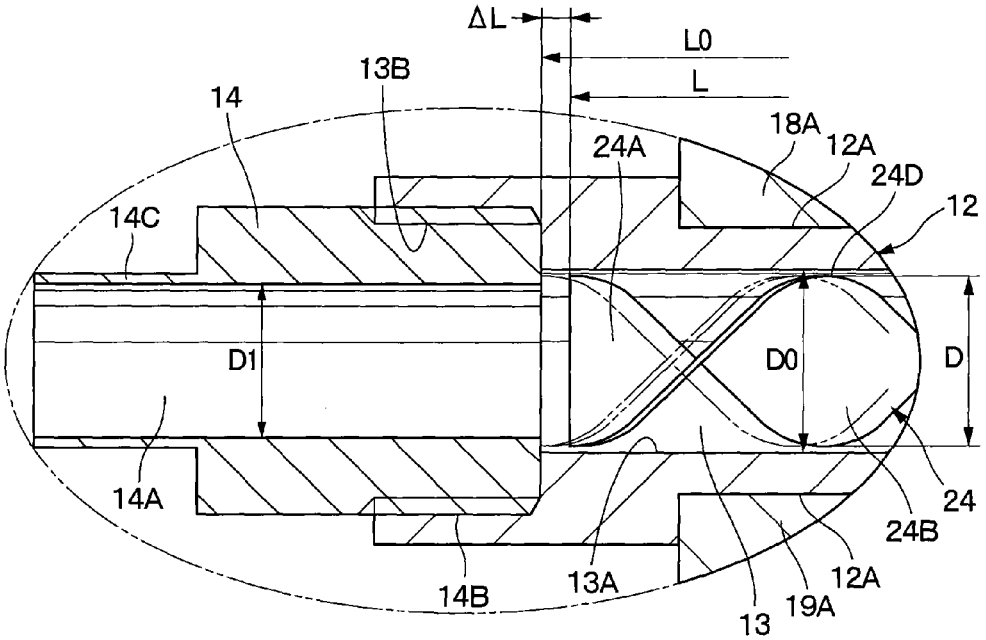
FIG. 5 is a longitudinal cross-sectional view shown by enlarging a V part in FIG. 2.
Figure 6:
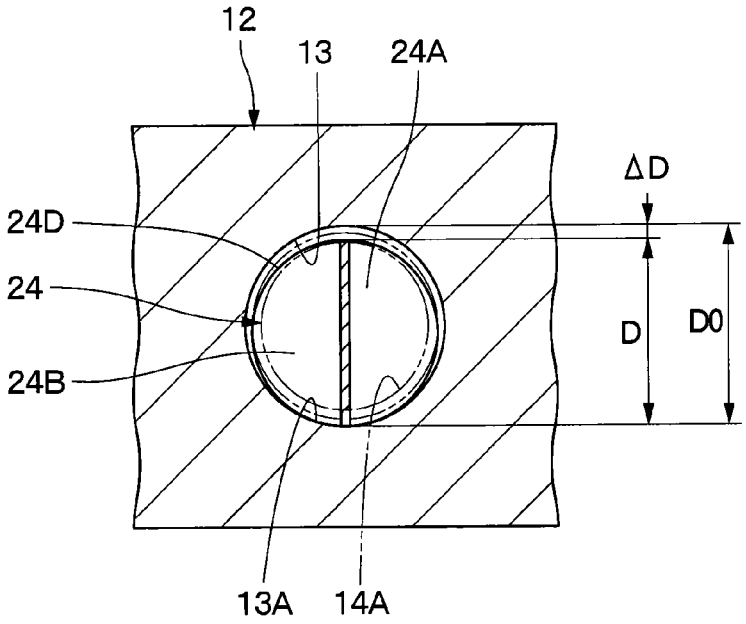
FIG. 6 is a transverse cross-sectional view of essential portions of a paint passage and a swirl flow forming member as viewed in the direction of an arrow VI-VI in FIG. 2.
Figure 7:
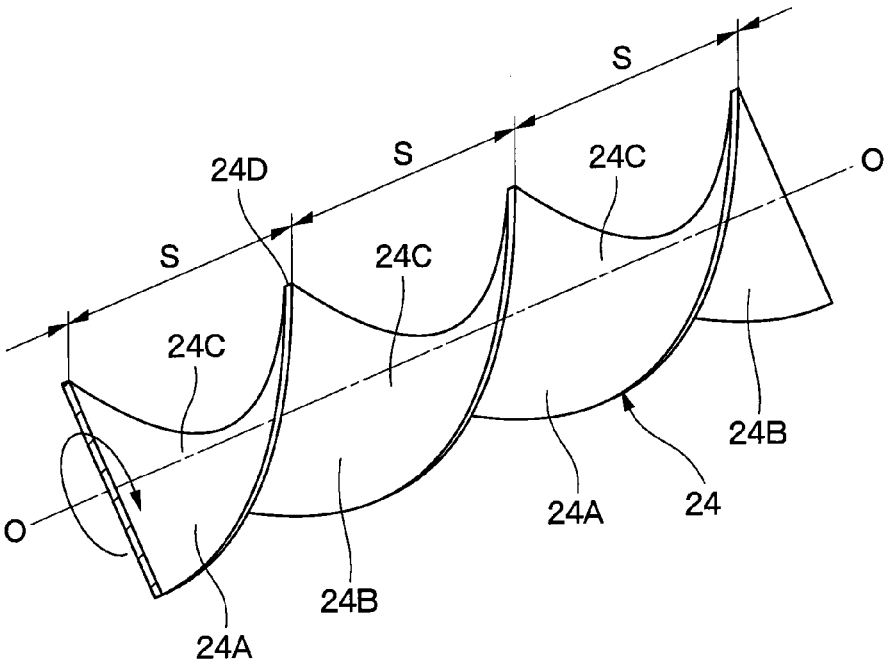
FIG. 7 is a perspective view shown by enlarging a part of the swirl flow forming member.

As shown in FIG. 5, a joint mount portion 13B of a female screw hole is provided to be enlarged at the downstream side of the paint passage 13, and a male screw portion 14B of the joint member 14 to be described later is threaded into the joint mount portion 13B. On the other hand, as shown in FIG. 3, the upstream side of the paint passage 13 forms an opening portion 13C for inserting or withdraw the swirl flow forming member 24 to be described later. An inner periphery of the opening portion 13C forms a female screw hole 13C1 and when a male screw portion 15B of the lid member 15 to be described later is threaded into the female screw hole 13C1, the opening portion 13C can be closed in an air-liquid-tight manner.

Indicated at 14 is the joint member as a positioning member mounted to the joint mount portion 13B to be positioned at the downstream side of the paint passage 13. The joint member 14 is formed as a stepped cylindrical body an inside of which forms a communication passage 14A, and a base end of which forms the male screw portion 14B threaded into the joint mount portion 13B in the paint passage 13. On the other hand, the fore end side of the joint member 14 forms a connector portion 14C having a small diameter, and the connector portion 14C is connected to the paint supply line 5.

An inside diameter dimension D1 of the communication passage 14A is set to a diameter dimension smaller than an outside diameter dimension D of the swirl flow forming member 24 to be described later. Therefore, the joint member 14 allows the paint or the wash liquid to flow out through the communication passage 14A from the paint passage 13, and serves as a positioning member for determining the movement end of the swirl flow forming member 24 to the downstream side by making contact with a fore end of the swirl flow forming member 24 at the time of moving downstream side.

Indicated at 15 is the lid member mounted to the opening portion 13C to be positioned at the upstream side of the paint passage 13. The lid member 15 closes the opening portion 13C, and also serves as a positioning member for determining the movement end of the swirl flow forming member 24 to the upstream side by making contact with a base end of the swirl flow forming member 24 at the time of moving upstream side. The lid member 15 has a fore end side which forms an insertion portion 15A inserted into the paint passage 13, and a base end side which forms the male screw portion 15B threaded into the female screw hole 13C1 of the opening portion 130 to be capable of being mounted thereto/removed therefrom.

A length dimension of the insertion portion 15A is, at the time of threading the male screw portion 15B to a predetermined position to the opening portion 13C, set in such a manner that a fore end surface of the insertion portion 15A comes to the same position with the upstream side end edge of the connector passage 12B positioned at the most upstream side. Therefore, the lid member 15 can prevent the paint from stagnating upstream of the connector passage 12B at the most upstream side or the wash air and the wash liquid having flown out from the connector passage 12B from reversely flowing to the upstream side, thus making it possible to increase the wash efficiency by the wash air or wash liquid supplied from the connector passage 12B.

When the joint member 14 is mounted to the joint mount portion 13B in the paint passage 13 and the lid member 15 is mounted to the opening portion 13C in this way, the joint member 14 and the lid member 15 can determine a range in which the swirl flow forming member 24 axially moves in the paint passage 13. At this time, an effective length dimension of the paint passage 13 is an axial length dimension L0 between the joint member 14 and the lid member 15, and is set to be longer then an axial length dimension L of the swirl flow forming member 24 (refer to FIG. 2).

Next, the structure of each of the wash air valve 16, the wash liquid valve 17, and the paint valves 18 to 23 of color A to F, which are provided in the manifold 12, will be explained. Here, each of the valves 16, 17, and 18 to 23 is formed of an air driven type opening/closing valve of a normally closed type having two ports and two positions, and has substantially the same structure with each other. Therefore, the wash air valve 16 will be exemplified as a representative of the other respective valves 17, and 18 to 23, the structure of which will be described.

The wash air valve 16 is provided to be connected to one of the two connector passages 12B positioned at the most upstream side among the respective connector passages 12B of the manifold 12. The wash air valve 16 forms a wash fluid valve together with the wash liquid valve 17. The wash air valve 16 performs supply and blockade of wash air to the paint passage 13. An inlet side of the wash air valve 16 is connected through the air line 4A to the wash air source 3Ar, and an outlet side thereof is connected through the connector passage 12B to the paint passage 13.

The wash air valve 16 is an air driven type opening/closing valve of a normally closed type having two ports and two positions, which normally closes by pressing a piston 16H with an urging force of a valve spring 16K to be described later, and which opens against the urging force of the valve spring 16K by supply of pressurized air to a pressure receiving chamber 16B1 in a piston chamber 16B.

As shown in FIG. 3, the wash air valve 16 is provided with a valve case 16A forming a contour of the wash air valve 16, and the piston chamber 16B, a valve chamber 16C, and a valve body insertion hole 16D establishing communications between the two chambers 16B and 16C are axially provided in the valve case 16A. An inlet port 16E is provided to a side of the valve chamber 16C, and is connected through the air line 4A to the wash air source 3Ar. Further, the annular valve seat 16F forming a part of the valve chamber 16C is provided to the valve case 16A in a position opposing a valve body 16J to be described later, and an outlet port 16G formed in an inner peripheral side of the valve seat 16F flows out the wash air toward the connector passage 12B in the manifold 12 from the valve chamber 16C.

The piston 16H is slidably inserted into the piston chamber 16B in the valve case 16A and this piston 16H defines the piston chamber 16B into the pressure receiving chamber 16B1 to which pilot air is supplied and a spring chamber 16B2. The valve body 16J provided in an axis center position of the piston 16H is slidably inserted into the valve body insertion hole 16D, and extends into the valve chamber 16C, a fore end of which is seated on/unseated from the valve seat 16F.

The valve body 16J is regularly seated on the valve seat 16F to close the outlet port 16G by pressing the piston 16H by the valve spring 16K provided in the spring chamber 16B2 in the piston chamber 16B. On the other hand, the pilot air is supplied to the pressure receiving chamber 16B1 in the piston chamber 16B to displace the piston 16H in a reverse direction against the valve spring 16K, thereby the valve body 16J can be opened to supply the wash air through the outlet port 16G to the paint passage 13.

The wash liquid valve 17 is provided to be connected to the other connector passage 12B positioned at the most upstream side to oppose the wash air valve 16. The wash liquid valve 17 performs supply and blockade of the wash liquid to the paint passage 13, and forms part of the wash fluid valve together with the wash air valve 16. An inlet side of the wash liquid valve 17 is connected through a liquid line 4B to the wash liquid source 3Lq, and an outlet side thereof is connected through the connector passage 12B to the paint passage 13. The wash liquid valve 17 is structured as an air driven type opening/closing valve of a normally closed type having two ports and two positions in the same way with the aforementioned wash air valve 16, which is normally closed and is opened by supply of the pilot air. Accordingly, the wash liquid valve 17 is structured as similar to the wash air valve 16, by a valve case 17A, a piston chamber 17B (pressure receiving chamber 17B1 and spring chamber 17B2), a valve chamber 17C, a valve body insertion hole 17D, an inlet port 17E, a valve seat 17F, an outlet port 17G, a piston 17H, a valve body 17J, and a valve spring 17K.

Accordingly, in a case of washing the paint stagnant in the paint passage 13 in the manifold 12, the wash air valve 16 and the wash liquid valve 17 alternately opens and closes to supply the wash air and the wash liquid into the paint passage 13 from the respective connector passages 12B, making it possible to wash the paint stagnant in the paint passage 13.

Indicated at 18 to 23 are the paint valves of color A, color B, color C, color D, color E, and color F provided on the manifold 12 to be positioned at the downstream side of the wash air valve 16 and the wash liquid valve 17. The paint valves 18 to 23 of color A to F are provided to be connected to the connector passages 12B positioned at the downstream side of the two connector passages 12B at the most upstream side among the respective connector passages 12B provided in the manifold 12. Therefore, inlet ports 18E to 23E of the paint valves 18 to 23 of color A to F are connected through the respective paint lines 2A to 2F to a color A paint source 1A to a color F paint source 1F, and outlet ports 18G to 23G thereof are connected through the respective connector passages 12B to the paint passage 13 in the manifold 12.

Here, each of the paint valves 18 to 23 of color A to F is, as similar to the wash air valve 16 and the wash liquid valve 17 as described above, structured as an air driven type opening/closing valve of a normally closed type having two ports and two positions, which is normally closed, and is opened by supply of the pilot air. Accordingly, the paint valves 18 to 23 of color A to F are structured, as similar to the wash air valve 16, by valve cases 18A to 23A, piston chambers 18B to 23B (pressure receiving chambers 18B1 to 23B1 and spring chambers 18B2 to 23B2), valve chambers 18C to 23C, valve body insertion holes 18D to 23D, inlet ports 18E to 23E, valve seats 18F to 23F, outlet ports 18G to 23G, pistons 18H to 23H, valve bodies 18J to 23J, and valve springs 18K to 23K.

The color change valve device 11, for example, in a case of supplying a color A paint to the coater unit 8, opens the color A paint valve 18, thus flowing out the color A paint supplied from the paint source 1A through the connector passage 12B in the manifold 12 into the paint passage 13. Thereby, the color A paint can be supplied through the paint supply line 5 or the like toward the coater unit 8.

On the other hand, when each of the paint valves 18 to 23 closes, each of the valve bodies 18J to 23J is seated on each of the valve seats 18F to 23F to close each of the outlet ports 18G to 23G in each of the valve seats 18F to 23F positioned in the inner part of each of the connector passages 12B. Therefore, each of the connector passages 12B is opened as a bottomed hole to the inner wall surface 13A of the paint passage 13. The paint supplied into the paint passage 13 enters into each of the connector passages 12B formed in the bottomed hole shape and stagnates therein. However, the paint stagnant on the bottom side of each of the connector passages 12B can not be easily washed simply by flowing the wash air and the wash liquid straight from the upstream side to the downstream side in the paint passage 13.

Next, an explanation will be made of a structure, an operation and the like of the swirl flow forming member 24 provided for increasing the wash performance at the time of washing the paint stagnant in the paint passage 13. A flexible resin material or a flexible metallic material is used as the structure of the swirl flow forming member 24, but the first embodiment exemplifies a case of forming the swirl flow forming member 24 using a single thin plate made of an aluminum alloy as an example of the flexible metallic material.

That is, designated at 24 is a single swirl flow forming member provided in the paint passage 13 in the color change valve device 11, and the swirl flow forming member 24 is arranged across a substantially entire length of the paint passage 13. Since the swirl flow forming member 24 can form a swirl flow, the wash air and the wash liquid can be made to flow toward the inner wall surface 13A of the paint passage 13 to improve the wash performance on the paint stagnant in each of the connector passages 12B in the manifold 12 and in the paint passage 13. It should be noted that the swirl flow forming member 24 is only required to be substantially arranged across the entire length to the paint passage 13, and it does not mean that the passage length of the paint passage 13 is equal in dimension to the length of the swirl flow forming member 24.

As an example of the manufacture process of the swirl flow forming member 24 is described, the swirl flow forming member 24 forms a single, long, thin plate body formed using a flexible metallic material, for example, a light alloy material of an aluminum alloy or the like. By gripping both ends of the long thin plate body and relatively rotating both the ends around an axis line O-O in FIG. 7, the thin plate body can be twisted to be formed in a spiral shape. Here, as the twisting direction of the spiral is described, the swirl flow forming member 24 forms the spiral by rotating the fore end side thereof in a clockwise direction (arrow direction in FIG. 7).

As to the swirl flow forming member 24 thus manufactured, in a case where one surface thereof is defined as a front surface 24A and the other surface is defined as a back surface 24B, the front surface 24A and the back surface 24B are reversed to be twisted by 180 degrees, thereby forming a spiral of a unit length (range shown by S in FIG. 4 and FIG. 7), which is defined as a unit spiral 24C. Accordingly, the swirl flow forming member 24 is structured as one long body by axially and successively forming many unit spirals 24C. It should be noted that the swirl flow forming member 24 may be manufactured using the other processing means of a mold process or the like except the aforementioned twisting processing means.

The swirl flow forming member 24 is provided to be movable across an entire length in the paint passage 13 of the manifold 12. Specifically the swirl flow forming member 24 is formed having a radial outside diameter dimension D smaller by a slight radial gap ΔD than an inside diameter dimension D0 of the paint passage 13. The radial gap ΔD is only required to allow the swirl flow forming member 24 to radially vibrate, and therefore is set to a slight dimension. Herein, the inside diameter dimension D0 of the paint passage 13 may be set as needed based upon conditions such as the numbers of the paint valves mounted in the manifold 12, a size of a work piece (required paint flow quantity), a kind of a paint, properties of a paint, and the like. In a case of considering that the inside diameter dimension D0 of the paint passage 13 differs, the radial gap ΔD is preferably set in a range of the following formula 1.

$$\Delta D = 0.1 \text{ to } 3.0 \text{ mm} \qquad \text{[Formula 1]}$$

On the other hand, the outside diameter dimension D of the swirl flow forming member 24 has a dimension larger than the inside diameter dimension D1 of the communication passage 14A in such a manner as not to pull out of the communication passage 14A in the joint member 14 (D1<D<D0). Therefore when the swirl flow forming member 24 is arranged in any position deviating from the axis center position of the paint passage 13 by the radial gap ΔD, wherein the wash air or the wash liquid is supplied into the paint passage 13, the swirl flow forming member 24 radially vibrates or circumferentially rotates in the paint passage 13 subjected to pressures of the pressurized fluids.

Moreover, as shown in FIG. 2, the swirl flow forming member 24 is set to a dimension having an axial length dimension L shorter than a length dimension L0 of the paint passage 13. As shown in FIG. 5, the axial length dimension L of the swirl flow forming member 24 is set to a dimension shorter by a slight axial gap ΔL formed between the fore end portion of the swirl flow forming member 24 and the joint member 14 in a state where the base end portion of the swirl flow forming member 24 makes contact with the lid member 15 (L<L0). The axial gap ΔL is set to a slight dimension so that the swirl flow forming member 24 is only required to axially vibrate. Here, the length dimension L0 of the paint passage 13 is set as needed based various conditions substantially in the same way with the inside diameter dimension D0 of the paint passage 13 as described above. In a case of considering that the length dimension L0 of the paint passage 13 differs, the axial gap ΔL is preferably set in a range of the following formula 2.

$$\Delta D = 0.1 \text{ to } 8.0 \text{ mm} \qquad \text{[Formula 2]}$$

The swirl flow forming member 24 has an outer peripheral surface 24D facing the inner wall surface 13A of the paint passage 13 to be in close proximity thereto, and therefore can form a swirl flow in the paint passage 13. The swirl flow can direct the wash air and the wash liquid toward the inner wall surface 13A of the paint passage 13 as shown by many arrows in FIG. 4.

Further, the swirl flow forming member 24 is formed by using a flexible aluminum alloy in a relatively light weight, and is arranged in a state of being movable freely in a radial direction (right and left directions, and upward and downward directions), an axial direction (front and rear directions), and a circumferential direction (rotational direction) in the paint passage 13. Accordingly, when the wash air valve 16 and the wash liquid valve 17 open to supply the wash air and the wash liquid into the paint passage 13 from the respective connector passages 12B, the swirl flow forming member 24 appropriately deflects to be capable of radially and axially vibrating actively and of rotating (rotating on its axis) around an axis O-O (refer to FIG. 7).

That is, the swirl flow forming member 24 is formed in a spiral shape across a substantially entire length of the paint passage 13. With the function of the spiral shape, the swirl flow forming member 24 can generate the swirl flow of the wash fluid from upstream end to downstream end in the paint passage 13. Accordingly, the wash fluid is directed to a radial outside across the substantially entire surface of the inner wall surface 13A of the paint passage 13 including the respective connector passages 12B in the manifold 12 opened to the inner wall surface 13A of the paint passage 13.

On the other hand, the swirl flow forming member 24 is formed by using a member having flexibility in a light weight, and is arranged in a non-fixed manner in a range defined within the paint passage 13. Therefore, the swirl flow forming member 24 can freely move in the defined range within the paint passage 13 when the wash air or the wash liquid operates thereon.

In this case, since the wash air valve 16 and the wash liquid valve 17 are provided in opposing positions in a diametrical direction at the upstream end portion of the manifold 12, the outlet port 16G of the wash air and the outlet port 17G of the wash liquid open to the paint passage 13 to face each other.

Further, at washing, the wash air from the wash air valve 16 and the wash liquid from the wash liquid valve 17 are alternately supplied into the paint passage 13 a plurality of times.

Under these conditions, when the wash air and the wash liquid are supplied into the paint passage 13, the swirl flow forming member 24 causes complex behaviors of jiggly deflecting deformations and vibrations in the paint passage 13, and these behaviors are transmitted to the wash air and the wash liquid, making it possible to form a complex swirl flow.

As a result, the swirl flow forming member 24 repeatedly collides with the inner wall surface 13A of the paint passage 13 by the complex behaviors of the vibration, the rotation and the like to shear the paint stagnant on the inner wall surface 13A side and cause the wash air and the wash liquid to actively collide with the inner wall surface 13A of the paint passage 13, making it possible to certainly wash the paint having adhered to the inner wall surface 13A. In addition, the wash air and the wash liquid can easily wash away the paint stagnant in the connector passage 12B opened to the inner wall surface 13A.

The color change valve device 11 according to the first embodiment has the structure as described above. Next, an explanation will be made of a color change operation of the color change valve device 11, for example, a color change operation in a case where a spray work using the color A paint is completed and the color B paint as the next color is supplied.

When the spray work using the color A paint is completed, the valve body 18J of the color A paint valve 18 is seated on the valve seat 18F to be closed, which blocks the corresponding connector passage 12B. In a state where the trigger valve 8D of the coater unit 8 is opened, the wash air valve 16 and the wash liquid valve 17 of the color change valve device 11 are alternately opened.

When the wash air valve 16 is opened, the wash air supplied from the wash air source 3Ar flows through the connector passage 12B into the paint passage 13, and collides with the swirl flow forming member 24 to be formed as a swirl flow for flowing. At this time, since the swirl flow forming member 24 is provided in a state of being movable in the paint passage 13, it can vibrate or circumferentially rotate by collision with the wash air, and the color A paint can be pushed out by the wash air.

Next, when the wash liquid valve 17 is opened, as similar to the flow of the aforementioned wash air, the wash liquid supplied from the wash liquid source 3Lq flows through the connector passage 12B into the paint passage 13. At this time, the swirl flow forming member 24 can vibrate or circumferentially rotate by collision with the wash liquid, and the color A paint can be washed by the wash liquid.

Here, since the wash air and the wash liquid having flown into the paint passage 13 flow in such a manner as to swirl along the front surface 24A and the back surface 24B spirally formed in the swirl flow forming member 24, a centrifugal force by the swirl flow causes the wash air and the wash liquid to flow radially outside toward the inner wall surface 13A of the paint passage 13. Therefore, the wash air and the wash liquid can be actively supplied to the color A paint having adhered to the inner wall surface 13A of the paint passage 13 and the color A paint stagnant in the respective connector passages 12B. As a result, the color A paint having adhered to the inner wall surface 13A or having entered into the respective connector passages 12B can be washed by the wash air and the wash liquid in a short time.

The wash air and the wash liquid flowing into the paint passage 13 in a pressurized state collide with the swirl flow forming member 24 to cause the deflecting deformation, and the axial and radial vibrations or the rotation of the swirl flow forming member 24. The complex movement of the swirl flow forming member 24 can divide or stir the color A paint stagnant on the inner wall surface 13A of the paint passage 13, and therefore the inner wall surface 13A of the paint passage 13 can be efficiently washed. Further, the wash air and the wash liquid flowing out from the paint passage 13 can wash also the color A paint stagnant in the paint supply line 5.

When the wash work of the paint passage 13, the paint supply line 5 and the like is completed, the color B paint valve 19 is opened to replenish the paint passage 13, the paint supply line 5 and the like with the color B paint from the color B paint source 1B and to prepare for the spray work of the color B paint.

Next, descriptions will be made of a case of performing the maintenance work of the inspection, wash, replacement or the like on the swirl flow forming member 24. In this case, by loosing and removing the lid member 15 mounted to the opening portion 13C of the paint passage 13, it is possible to open the opening portion 13C, and the swirl flow forming member 24 can be pulled out and removed from the opening portion 13C. The removed swirl flow forming member 24 can remove paint films or residues having adhered thereto by use thereof for a long period of time.

Thus, according to the first embodiment, the swirl flow forming member 24 is provided across the substantially entire length of the paint passage 13 in the manifold 12. In this case, the swirl flow forming member 24 successively forms many unit spirals 24C, each unit spiral 24C composing of the front surface 24A and the back surface 24B reversed by 180-degree twist of the swirl flow forming member 24. Therefore, when the paint, or the wash air and the wash liquid flow in the paint passage 13, the swirl flow forming member 24 can form the swirl flow in the fluid flowing in the paint passage 13.

In this way, since the wash air and the wash liquid supplied into the paint passage 13 can flow in such a manner as to swirl along the front surface 24A and the back surface 24B of the swirl flow forming member 24, the wash air and the wash liquid flowing from the upstream side to the downstream side in the paint passage 13 can be made to flow toward a radial outside of the paint passage 13, that is, toward the entire surface of the inner wall surface 13A of the paint passage 13. Therefore, the wash air and the wash liquid can be actively flown into the respective connector passages 12B opened to the inner wall surface 13A of the paint passage 13.

Further, the swirl flow forming member 24 adopts the flexible member to be provided in a state of being freely movable in the paint passage 13. Therefore, the swirl flow forming member 24 can deform in a deflective manner, axially and radially vibrate or circumferentially rotate by the wash air and the wash liquid supplied. Such vibration or rotation of the swirl flow forming member 24 enables the paint stagnant on the inner wall surface 13A of the paint passage 13 to be divided or stirred.

As a result, at the time of washing the paint passage 13, the complex movements of the deformation, the vibration, the rotation and the like of the swirl flow forming member 24 can efficiently push and flow the paint stagnant on the inner wall surface 13A of the paint passage 13. In addition, since the swirl flow forming member 24 formed in a spiral shape can actively flow the wash air and the wash liquid into the respective connector passages 12B, the paint stagnant on the inner wall surface 13A and the connector passages 12B can be also washed in a short time.

Here, a so-called metallic paint containing aluminum powder as luster pigment, since the aluminum powder is larger in specific gravity than the other paint component, when the flow of the paint stops, is separated to go down to the downward side (bottom surface) of the paint passage 13, and results in easily stagnating thereon. However, as described above, the deformation, the vibration, and the rotation of the swirl flow forming member 24 in the paint passage 13 can push and flow out also the stagnant aluminum powder, and easily wash even the metallic paint having a large specific gravity.

Since the swirl flow forming member 24 is formed by a single plate body, the swirl flow forming member 24 can eliminate the step between the respective unit spirals 24C. Therefore, the wash air and the wash liquid can be smoothly flown along the swirl flow forming member 24, increasing a flow velocity of each of the wash air and the wash fluid to improve the wash performance. Further, the swirl flow forming member 24 formed of the single plate body can be easily inserted into or removed from the paint passage 13, thus improving the workability of the maintenance or the like.

The swirl flow forming member 24 formed by the aluminum alloy having the flexibility can be deflected subjected to a pressure of the wash air or the wash liquid supplied, and can actively generate vibration. Thereby, since the outer peripheral surface 24D of the swirl flow forming member 24 can repeatedly make contact with the inner wall surface 13A of the paint passage 13, the previous color paint stagnant on the inner wall surface 13A of the paint passage 13 can be divided and stirred to increase the wash efficiency.

Since the outside diameter dimension D of the swirl flow forming member 24 is formed to be smaller by the radial gap ΔD than the inside diameter dimension D0 of the paint passage 13, it is possible to radially vibrate or circumferentially rotate the swirl flow forming member 24 in the paint passage 13. In addition, it is possible to deform the swirl flow forming member 24 in a deflective manner.

Since the length dimension L of the swirl flow forming member 24 is formed to be shorter by the axial gap ΔL than the length dimension L0 of the paint passage 13, the swirl flow forming member 24 can be made to axially vibrate in the paint passage 13.

Further, the joint member 14 is provided in the downstream end portion of the manifold 12 to allow outflow of the paint, the wash air, and the wash liquid supplied into the paint passage 13 to the side of the paint supply line 5, and to determine the movement end of the swirl flow forming member 24 to the downstream side. Therefore, the joint member 14 can flow the paint or the like, while positioning the fore end of the swirl flow forming member 24 in such a manner that the swirl flow forming member 24 does not withdraw to the downstream side. On the other hand, since the opening portion 13C of the paint passage 13 is provided in the upstream end portion of the manifold 12, the swirl flow forming member 24 can be easily inserted into or removed from the paint passage 13 through the opening portion 13C. Further, in a state of mounting the lid member 15 to the opening portion 13C, the opening portion 13C can be closed by the lid member 15, and the lid member 15 can determine the movement end of the swirl flow forming member 24 to the upstream side in such a manner that the swirl flow forming member 24 does not withdraw to the upstream side.

Figure 8:
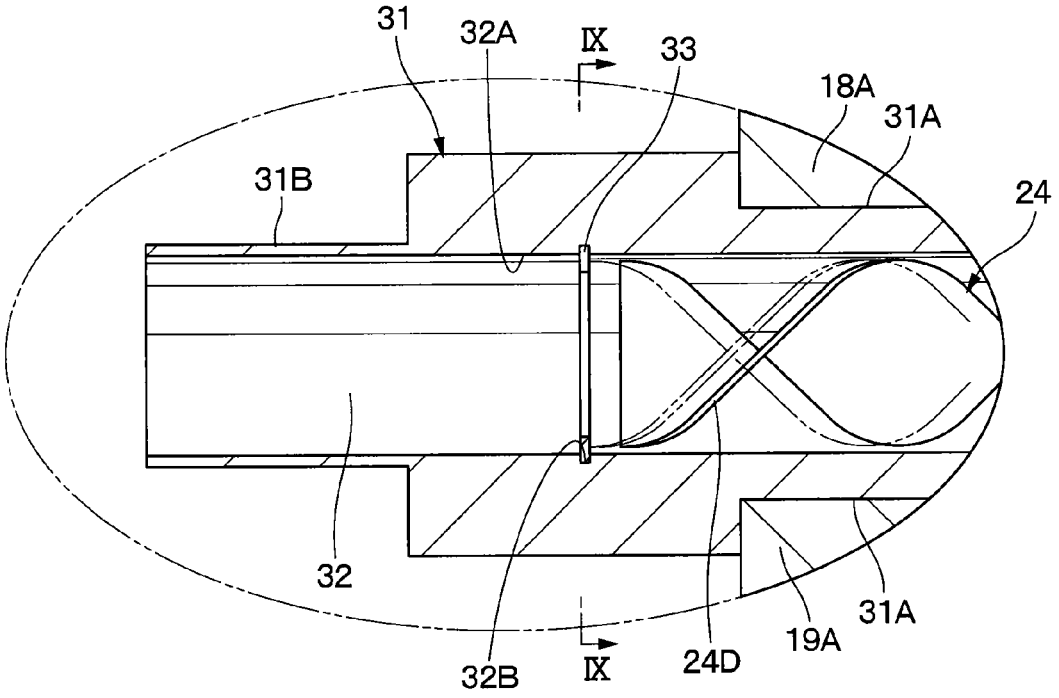
FIG. 8 is a longitudinal cross-sectional view shown by enlarging a principle part of a color change valve device according to a second embodiment of the present invention.
Figure 9:
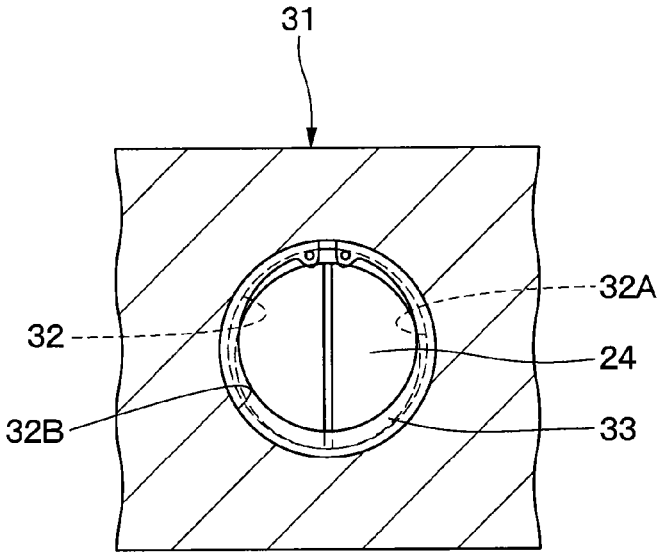
FIG. 9 is a transverse cross-sectional view of a paint passage, a swirl flow forming member, and a retaining ring as viewed in the direction of an arrow IX-IX in FIG. 8.

Next, FIG. 8 and FIG. 9 show a second embodiment in the present invention. The second embodiment is characterized in the structure that a retaining ring is used as a positioning member for positioning the fore end of a swirl flow forming member inserted into a paint passage. It should be noted that in the second embodiment, the component elements that are identical to those of the foregoing first embodiment will be simply denoted by the same reference numerals to avoid repetitions of similar explanations.

In FIG. 8, designated at 31 is a manifold in the second embodiment and this manifold 31 is, as substantially similar to the manifold 12 according to the first embodiment, formed of a rectangular column-shaped body, and is provided with valve mount recesses 31A and connector passages (not shown) on opposing surface portions thereof. On the other hand, a cylindrical joint tube 31B is provided to project at the downstream side of the manifold 31 in such a manner as to be coaxial with a paint passage 32 to be described later, and the paint supply line 5 is connected to the joint tube 31B.

Indicated at 32 is the paint passage provided to axially extend inside the manifold 31 and this paint passage 32 serves as a passage in which the paint, the wash air and the wash liquid flow. The paint passage 32 is formed as a circular passage to axially penetrate through the axis central part of the manifold 31, and an annular groove 32B is formed to be enlarged at the downstream side of an inner wall surface 32A of the paint passage 32. A retaining ring 33 to be described later is mounted to the annular groove 32B.

Indicated at 33 is the retaining ring as the positioning member mounted to the annular groove 32B to be positioned at the downstream side in the paint passage 32. As the retaining ring 33, a retaining ring for hole commercially available is used, which can be easily mounted and removed. As shown in FIG. 9, the retaining ring 33 adopts a retaining ring which has a size of an opening at the inner peripheral side smaller than an outside diameter dimension of the swirl flow forming member 24 in a state of being mounted to the annular groove 32B. Therefore, the retaining ring 33 allows the paint, the wash air or the wash liquid to flow out from the paint passage 32, and can serve as a positioning member for performing the positioning of the fore end of the swirl flow forming member 24 by making contact with the swirl flow forming member 24 which is going to move to the downstream side.

In this way, also in the second embodiment thus structured, an operational effect substantially similar to that of the first embodiment can be obtained. Particularly according to the second embodiment, the commercially available retaining ring 33 for hole is used as the downstream side positioning member for positioning the fore end of the swirl flow forming member 24, the retaining ring 33 is less expensive, and besides, can be easily mounted simply by forming the annular groove 32B.

It should be noted that in the first embodiment, the explanation is made by taking a case of structuring the swirl flow forming member 24 as the single thin plate comprising the plurality of the unit spirals 24C successively formed, as an example. However, the present invention is not limited to the same, and may be structured such that independent unit spirals are formed and the respective unit spirals are successively connected by a bonding means or the like to form a single swirl flow forming member. The structure may be applied similarly to the second embodiment.

The first embodiment exemplifies a case of forming the swirl flow forming member 24 by using the aluminum alloy having flexibility. However, the present invention is not limited to the same, and may be formed by using a metallic material other than the aluminum alloy, for example, for forming the swirl flow forming member. Further, the swirl flow forming member may be structured by using a flexible resin material, such as polytetrafluoroethylene (PTFE), polyether ether ketone (PEEK), polyetherimide (PEI), polyoxymethylene (POM), polyimide (PI), or ployethylene terephthalate (PET). These components may be applied similarly to the second embodiment.

In addition, the explanation is made of the first embodiment by taking a case of forming the spiral by rotating the fore end side of the swirl flow forming member 24 in a clockwise direction, as an example. However, the present invention is not limited to the same, and the spiral may be formed by rotating the fore end side of the swirl flow forming member 24 in a counterclockwise direction.

Further, each of the embodiments is explained by taking a case of supplying the paint selected by the color change valve device 11 to the electrostatic rotary atomizing head type coater unit 8 equipped with the high voltage generator 10, as an example. However, the present invention is not limited to the same, and, for example, the color change valve device 11 may be structured to be used for supplying the paint to a coater unit, a non-electrostatic coater unit or the like equipped with a spray gun, a hydraulic atomizing nozzle or the like.

DESCRIPTION OF REFERENCE NUMERALS

1A to 1F: Paint sources of color A to F
3Ar: Wash air source
3Lq: Wash liquid source
11: Color change valve device
12, 31: Manifold
12B: Connector passage
13, 32: Paint passage
13A, 32A: Inner wall surface
13B: Joint mount portion
13C: Opening portion
14: Joint member (Positioning member)
15: Lid member
16: Wash air valve (Wash fluid valve)
17: Wash liquid valve (Wash fluid valve)
18 to 23: Paint valves of color A to F
24: Swirl flow forming member
24A: Front surface
24B: Back surface
24C: Unit spiral
24D: Outer peripheral surface
33: Retaining ring (Positioning member)
D: Outside diameter dimension of a swirl flow forming member
D0: Inside diameter dimension of a paint passage
D1: Inside diameter dimension of a communication passage in a joint member
ΔD: Radial gap
L: Length dimension of a swirl flow forming member
L0: Length dimension of a paint passage
ΔL: Axial gap
S: Range of a unit spiral

The invention claimed is:

1. A color change valve device comprising:

a manifold including an internal paint passage to which connector passages are provided to radially penetrate therethrough at plural locations axially spaced from each other;

a wash fluid valve provided to be connected to a most upstream one among said respective connector passages in said manifold for performing supply and blockade of a wash fluid to said paint passage; and plural paint valves provided to be connected to said connector passages in said manifold at a downstream side of said wash fluid valve for performing supply and blockade of paints to said paint passage;

a swirl flow forming member provided in said paint passage in said manifold for forming a swirl flow by the wash fluid in said paint passage, wherein said swirl flow forming member is arranged across an entire length of said paint passage, and wherein said swirl flow forming member is formed as a single member arranged in a state of being freely movable in said paint passage, and includes a plurality of successive unit spirals, each unit spiral comprising a front surface and a back surface reversed by 180-degree twist thereof.

2. The color change valve device according to claim 1, wherein said swirl flow forming member is structured by a single plate body comprising said plurality of said unit spirals successively formed.

3. The color change valve device according to claim 1, wherein said swirl flow forming member is formed using a resin material having flexibility or a metallic material having flexibility.

4. The color change valve device according to claim 1, wherein said swirl flow forming member is structured having a radial outside diameter dimension formed smaller by a radial gap than an inside diameter dimension of said paint passage to be radially movable to said paint passage.

5. The color change valve device according to claim 1, wherein said swirl flow forming member is structured having an axial length dimension formed shorter by an axial gap than a length dimension of said paint passage to be axially movable to said paint passage.

6. The color change valve device according to claim 1, further comprising:

a positioning member provided in a downstream end portion of said manifold to allow outflow of the fluid from said paint passage and to position a fore end of said swirl flow forming member inserted into said paint passage, an opening portion provided in an upstream end portion of said manifold to permit insertion and removal of said swirl flow forming member, and a lid member provided in a position for closing said opening portion, to position a base end of said swirl flow forming member.

* * * * *